United States Patent [19]

Campbell et al.

[11] 4,306,949

[45] Dec. 22, 1981

[54] ELECTROHYDRODIMERIZATION PROCESS

[75] Inventors: Charles R. Campbell; Christopher J. H. King; Matthew H. Luca, all of Pensacola, Fla.

[73] Assignee: Monsanto Company, St. Louis, Mo.

[21] Appl. No.: 105,182

[22] Filed: Dec. 19, 1979

[51] Int. Cl.[3] ..... C25D 3/10

[52] U.S. Cl. ..... 204/73 R; 204/72; 204/73; 204/78

[58] Field of Search ..... 204/73 R, 73 A, 72, 204/78

[56] References Cited

U.S. PATENT DOCUMENTS

| | | | |
|---|---|---|---|
| 2,758,075 | 8/1956 | Swalheim | 204/277 X |
| 3,397,226 | 8/1968 | Fenton | 204/78 X |
| 3,616,321 | 10/1971 | Verheyden et al. | 204/73 A |
| 3,630,860 | 12/1971 | Fox | 204/73 R |
| 3,669,852 | 6/1972 | Winters | 204/46 |
| 3,689,382 | 9/1972 | Fox et al. | 204/73 A |
| 3,871,976 | 3/1975 | Connolly | 204/73 A |
| 4,022,673 | 5/1977 | Connolly et al. | 204/73 R |
| 4,045,303 | 8/1977 | Campbell | 204/24 |
| 4,046,651 | 9/1977 | Burnett | 204/73 R |

FOREIGN PATENT DOCUMENTS

| | | | |
|---|---|---|---|
| 6610378 | 7/1966 | Netherlands . | |
| 1089707 | 11/1967 | United Kingdom | 204/73 A |

*Primary Examiner*—F. Edmundson

*Attorney, Agent, or Firm*—Thomas Y. Awalt, Jr.

[57] ABSTRACT

A non-competing gas is injected into an electrolytic cell to reduce the accumulation of competing gas at one of the electrode surfaces thereby to increase the efficiency of the cell.

5 Claims, No Drawings

ELECTROHYDRODIMERIZATION PROCESS

BACKGROUND OF THE INVENTION

Electrochemical processes include anodic and cathodic processes. For various reasons, energy conservation being paramount, it has been found desirable to employ undivided cells in many of such processes. Undivided cells, as a general rule are more efficient, so far as electrical consumption is concerned, than divided or membrane-type cells; but they have the disadvantage that a free interflow of the electrolyte, as well as electricity may result in a competing gas migrating to the reaction electrode. By "competing" is meant any gas which may consume electricity while being reduced or oxidized.

For example, electrochemical reduction processes, particularly those for the production of paraffinic dinitriles, dicarboxamides or dicarboxylates by electrolytic hydrodimerization of an alpha, beta-olefinic nitrile, carboxamide or carboxylate are well known. (U.S. Pat Nos. 3,193,475-79 and 3,193,481-83 issued July 6, 1965, to M. M. Baizer). Although such processes have been sufficiently attractive that they have been in commercial use for over fourteen years, efforts to develop improvements thereon have been continued with particular emphasis on lowering electric power costs and mitigating electrode corrosion and fouling tendencies because of which it has been heretofore commercially preferable to carry out the process with a cell-dividing membrane.

With the object of maintaining high electrolyte conductivity while employing an electrolysis medium containing organic salts in a proportion small enough for attractive use of a single-compartment (membraneless) cell, one approach to improvement of the process has been to use as the electrolysis medium in aqueous solution of a mixture of quaternary ammonium and alkali metal salts together with the olefinic compound to be hydrodimerized. An example of such an approach is described in Netherlands Patent Application No. 66,10378 laid open for public inspection Jan. 24, 1967, and further development thereof is described in U.S. Pat. No. 3,616,321 issued Oct. 26, 1971, to A. Verheyden et al. and U.S. Pat. No. 3,689,382 issued Sept. 5, 1972, to H. N. Fox et al. However, all known variations of the process are characterized by some degree of inefficiency in use of the electrolyzing current, and this problem is typically more significant in those process variations using an undivided cell.

Clearly, the higher the proportion of the electrolyzing current that reduces molecular oxygen rather than the desired hydrodimer, the greater the cost of production of the hydrodimer will be. Accordingly, a process improvement whereby an olefinic compound can be electrolytically hydrodimerized with a resulting lowered reduction of molecular oxygen and a thereby increased current efficiency is highly desirable, and it is an object of this invention to provide such an improvement. Additional objects of the invention will be apparent from the following description and Examples in which all percentages are by weight except where otherwise noted.

SUMMARY OF THE INVENTION

It has been discovered that in a continuous electrochemical process conducted in an undivided electrolytic cell where gas is generated at one electrode which may migrate to and accumulate at the other electrode, and complete with a desired reaction at the other electrode, the effect of the competing gas can be reduced by injecting a noncompeting gas into the electrolyte whereby the concentration of competing gas at the other electrode is diminished. In processes for electrochemical reduction generally and in particular processes for hydrodimerizing an olefinic compound having the formula $R_2C{=}CR{-}X$ wherein —X is —CN, $-CONR_2$ or —COOR', R is hydrogen or R' and R' is $C_1$–$C_4$ alkyl by electrolyzing an aqueous solution having dissolved therein at least about 0.1% by weight of the olefinic compound, at least about $10^{-5}$ gram mol per liter of quanternary ammonium or phosphonium cations and at least about 0.1% by weight of conductive salt in contact with a cathodic surface having a cathode potential sufficient for hydrodimerization of the olefinic compound, the content of oxygen in the aqueous electrolyte and at the cathodic surface can be significantly reduced with a commensurate reduction in corrosion of the cathodic surface and loss of current due to cathodic reduction of dissolved oxygen, by charging to the electrolyte an effective amount of a diluent gas.

This is especially significant where the aqueous electrolyte also includes one or more of a nitrilocarboxylic acid compound such as, for example, a nitriloacetic or nitrilopropionic acid compound having the formula $Y_2N{-}(Z{-}YN)_n R''{-}COOM$ where Y is a monovalent radical such as hydrogen, —R''—COOM, $-(CH_2)_m{-}_{+1}OH$ or $C_1$–$C_{20}$ alkyl; —R''— is $-(CH_2)_m$ or $-(CHR'')_n$; R''' is hydroxy, —COOM, $-(CH_2)_m COOM$ or $C_1$–$C_8$ alkyl, hydroxyalkyl or hydroxyphenyl; Z is a divalent $C_2$–$C_6$ hydrocarbon radical; M is a monovalent radical such as hydrogen, alkali metal or ammonium; m is 1 or 2; n is 0–4; and at least one Y is R''—COOM or $-(CH_2)_{m+1}OH$.

DETAILED DESCRIPTION OF THE INVENTION

While the invention is applicable to any electrochemical process conducted in an undivided electrolytic cell where gas may be generated at one electrode which may migrate to and accumulate at the other electrode and compete with the desired reaction at the other electrode, for the sake of convenience and accuracy it is herein described in detail in terms of a particular electrohydrodimerization process.

Olefinic compounds that can be hydrodimerized by the preferred process of this invention include those having the structural formula $R_2C{=}CR{-}X$ wherein —X is —CN, $-CONR_2$ or —COOR', R is hydrogen or R' and R' is $C_1$–$C_4$ alkyl (i.e. methyl, ethyl, n-propyl, isopropyl, n-butyl, isobutyl or tert-butyl). Compounds having that formula are known as having alpha, beta mono-unsaturation and in each such compound, at least one R may be R' while at least one other R is hydrogen and at least one R', if present, may be an alkyl group containing a given number of carbon atoms while at least one other R', if present, may be an alkyl group containing a different number of carbon atoms. Such compounds include olefinic nitriles such as, for example, acrylonitrile, methyacrylonitrile, crotononitrile, 2-methylenebutyronitrile, 2-penteneitrile, 2-methylenevaleronitrile, 2-methylenehexanenitrile, tiglonitrile or 2-ethylidenehexanenitrile; olefinic carboxylates such as, for example, methyl acrylate, ethyl acrylate or ethyl crotonate; and olefinic carboxamides such as, for example, acrylamide, methacrylamide, N-N-diethylacrylamide or N,N-diethylcrotonamide. Best results are generally obtained when the olefinic compound has at least one hydrogen atom directly attached to either of the two carbon atoms joined by the double bond in the aforedescribed structural formula. Also presently of greater utility in the process of this invention are those olefinic compounds where R′ in that formula is methyl or ethyl, and particularly acrylonitrile, methyl acrylate and alpha-methylacrylonitrile.

Products of hydrodimerization of such compounds have the structural formula X—CHR—$CR_2$—$CR_2$—CHR—X (wherein X and R are as stated above). They include paraffinic dinitriles such as, for example, adiponitrile and 2,5-dimethyladiponitrile; paraffinic dicarboxylates such as, for example, dimethyladipate and diethyl-3,4-dimethyladipate; and paraffinic dicarboxamides such as, for example adipamide, dimethyladipamide and N,N′-dimethyl-2,5-dimethyladipamide. Such hydrodimers can be employed as monomers or as intermediates convertible by known processes into monomers useful in the manufacture of high molecular weight polymers including polyamides and polyesters. The dinitriles, for example, can be hydrogenated by known processes to prepare paraffinic diamines especially useful in the production of high molecular weight polyamides.

The invention contemplates electrolyzing an electrolyte containing certain proportions of the olefinic compound to be hydrodimerized, quaternary ammonium or phosphonium cations and a conductive salt. The electrolysis medium may contain an undissolved organic phase. Hence in some embodiments of the invention, the electrolyte may be suitably electrolyzed in an electrolysis medium containing essentially no undissolved organic phase, by which is meant either no measurable amount of undissolved organic phase or a minute proportion of undissolved organic phase having no significant effect on the hydrodimer selectivity achieved when the electrolyte is electrolyzed in accordance with the process of this invention. Such a minute proportion, if present, would be typically less than 5% of the combined weight of the aqueous electrolyte and the undissolved organic phase in the electrolysis medium. In other embodiments, the process of this invention can be carried out by electrolyzing the electrolyte in an electrolysis medium consisting essentially of an aqueous solution and a dispersed but undissolved organic phase in a larger proportion (e.g. up to about 15%, 20% or even more of the combined weight of the electrolyte and the undissolved organic phase in the electrolysis medium) which may or may not significantly affect the hydrodimer selectivity depending on other conditions of the process. In some continuous process embodiments involving recycle of unconverted olefinic compound and whether present in a minute or larger proportion, such an organic phase is normally made up mainly (most commonly at least about 65% and even more typically at least about 75%) of the olefinic compound to be hydrodimerized and the hydrodimer product with some small amounts of organic hydrodimerization byproducts, quaternary ammonium or phosphonium cations, etc. possibly also present. Typically, such an organic phase contains at least about 10%, preferably between about 15% and about 50%, and even more desirably between about 20% and about 40% of the olefinic compound to be hydrodimerized. In any event, however, the concentrations of the constituents dissolved in the electrolyte to be electrolyzed, as set forth herein, are with reference to the aqueous solution alone and not the combined contents of said aqueous solution and an undissolved organic phase which, as aforesaid, may be present but need not be present in the electrolysis medium as the invention is carried out. On the other hand, the weight percentages of undissolved organic phase are based on the combined weight of the aqueous solution and the undissolved organic phase in the electrolysis medium.

Referring to the constituents of the aqueous phase, the olefinic compound to be hydrodimerized will be present in at least such a proportion that electrolysis of the electrolyte, as described herein, results in a substantial amount of the desired hydrodimer being produced. That proportion is generally at least about 0.1% of the aqueous solution, more typically at least about 0.5% and, in some embodiments, preferably at least about 1% of the aqueous solution. Inclusion of one or more additional constituents which increase the solubility of the olefinic compound in the electrolyte may permit carrying out the process with the electrolyte containing relatively high proportions of the olefinic compound, e.g. at least about 5% or even 10% or more, but in most embodiments, the aqueous solution contains less than about 5% (e.g. not more than 4.5%) of the olefinic compound and, in many of those embodiments, preferably not more than about 2% of the olefinic compound.

The minimum required proportion of quaternary ammonium or phosphonium cations is very small. In general, there need be only an amount sufficient to provide the desired hydrodimer selectively (typically at least about 75%) although much higher proportions can be present if desired or convenient. In most cases, the quaternary ammonium or phosphonium cations are present in a concentration of at least about $10^{-5}$ gram mol per liter of the aqueous solution. Even more typically their concentration is at least about $10^{-4}$ gram mol per liter of the solution and, in some embodiments employing monovalent monoquaternary ammonium or phosphonium cations, preferably at least about $5\times10^{-4}$ gram mol per liter. Although high proportions may be present in some cases, as aforesaid, the quaternary ammonium or phosphonium cations are generally present in the aqueous electrolyte in a concentration not higher than about 0.5 gram mol per liter and even more usually not higher than about $10^{-1}$ gram mol per liter. In some preferred embodiments, the concentration of quaternary ammonium or phosphonium cations in the solution is between about $10^{-4}$ and about $10^{-2}$ gram mol per liter.

The quaternary ammonium or phosphonium cations that are positively-charged ions in which a nitrogen or phosphorous atom has a valence of five and is directly linked to other atoms (e.g. carbon) satisfying four fifths of that valence. Such cations need contain only one pentavalent nitrogen or phosphorous atom as in, for example, various monovalent mono-quaternary ammonium (e.g. tetraalkylammonium) or mono-quaternary phosphonium (e.g. tetraalkylphosphonium) cations, but they may contain more than one of such pentavalent atoms as in, for example, various multivalent multiquaternary ammonium or phosphonium cations such as the bisquaternary ammonium or phosphonium cations, e.g. polymethylenebis (trialkylammonium or trialkylphosphonium) cations. Mixtures of such monovalent and multivalent quaternary ammonium and/or phosphonium cations can also be used. Suitable monoquaternary ammonium or phosphonium cations may be cyclic, as in the case of the piperidiniums, pyrrolidiniums and morpholiniums, but they are more generally of the type in which a pentavalent nitrogen or phosphorous atom is directly linked to a total of four monovalent organic groups preferably devoid of olefinic unsaturation and desirably selected from the group consisting of alkyl and aryl radicals and combinations thereof. Suitable multi-quaternary ammonium or phosphonium cations may likewise by cyclic, as in the case of the piperaziniums, and they are typically of a type in which the pentavalent nitrogen or phosphorous atoms are linked to one another by at least one divalent organic (e.g. polymethylene) radical and each further substituted by monovalent organic groups of the kind just mentioned sufficient in number (normally two or three) that four fifths of the valence of each such pentavalent atom is satisfied by such divalent and monovalent organic radicals. As such monovalent organic radicals, suitable aryl groups contain typically from six to twelve carbon atoms and preferably only one aromatic ring as in, for example, a phenyl or benzyl radical, and suitable alkyl groups can be straight-chain, branched or cyclic with each typically containing from one to twelve carbon atoms. Although quaternary ammonium or phosphonium cations containing a combination of such alkyl and aryl groups (e.g. benzyltriethylammonium or phosphonium ions) can be used, many embodiments of the invention are preferably carried out with quaternary cations having no olefinic or aromatic unsaturation. Good results are generally obtained with tetraalkylammonium or tetraalkylphosphonium ions containing at least three $C_2$–$C_6$ alkyl groups and a total of from 8 to 24 carbon atoms in the four alkyl groups, e.g. tetraethyl-, ethyltripropyl-, ethyltributyl-, ethyltriamyl-, ethyltrihexyl-, octytriethyl-, tetrapropyl-, methyltripropyl-, decyltripropyl-, methyltributyl-, tetrabutyl-, amyltributyl-, tetraamyl-, tetrahexyl-, ethyltrihexyl-, diethyldioctylammonium or -phosphonium and many others referred to in the aforecited U.S. Pat. Nos. 3,193,475-79 and '481-83. Generally most practical from the economical standpoint are those tetraalkylammonium ions in which each alkyl group contains from two to five carbon atoms, e.g. diethyldiamyl-, tetrapropyl-, tetrabutyl-, amyltripropyl-, tetraamylammonium, etc., and those $C_8$–$C_{20}$ tetraalkylphosphonium ions containing at least three $C_2$–$C_5$ alkyl groups, e.g. methyl-tributyl-, tetrapropyl-, ethyltriamyl-, octyltriethylphosphonium, etc. Particularly useful are the $C_8$–$C_{16}$ tetraalkylphosphonium ions containing at least three $C_2$–$C_4$ alkyl groups. Similarly good results are obtained by use of the divalent polymethylenebis(trialkylammonium or trialkylphosphonium) ions, particularly those containing a total of from 17 to 36 carbon atoms and in which each trialkylammonium or trialkylphosphonium radical contains at least two $C_3$–$C_6$ alkyl groups and the polymethylene radical is $C_3$–$C_8$, i.e., a straight chain of from three of eight methylene radicals. Presently most attractive from the economic standpoint are the $C_{18}$–$C_{32}$ polymethylenebis(trialkylammonium or trialkylphosphonium) ions in which each trialkylammonium or trialkylphosphonium radical contains at least two $C_3$–$C_5$ alkyl groups and the polymethylene radical is $C_4$–$C_6$. In many embodiments of the invention employing such polymethylenebis(trialkylammonium) ions, the carbon atom content of such ions is preferably from 20 to 34. Presently of specific interest for potential commercial use in the process of this invention are the $C_{20}$–$C_{34}$ hexamethylenebis(trialkylammonium) ions, e.g. those in which each trialkylammonium radical contains at least two $C_3$–$C_6$ alkyl groups, partly because water-soluble salts of such cations can be relatively simply prepared from hexamethylenediamine which is readily available in commercial quantities at relatively low cost. Also generally preferred are the hexamethylenebis(trialkylammonium or trialkylphosphonium) ions containing from 20 to 30 carbon atoms, e.g. those in which each trialkylammonium or trialkylphosphonium radical contains at least two $C_3$–$C_5$ alkyl groups, and especially the $C_{24}$–$C_{30}$ hexamethylenebis(trialkylammonium) ions in which each trialkylammonium radical contains at least one and preferably two n-butyl groups. Any of such cations can be incorporated into the aqueous solution to be electrolyzed in any convenient manner, e.g. by dissolving the hydroxide or a salt (e.g. a $C_1$–$C_2$ alkylsulfate) of the desired quaternary ammonium or phosphonium cation(s) in the electrolyte in the amount required to provide the desired concentration of such cations.

One significant advantage of the polymethylenebis(trialkylammonium) or trialkylphosphonium ions for use in the preferred process of this invention is that relative to most of the corresponding tetraalkylammonium and tetraalkylphosphonium ions of the type described hereinbefore, they tend to distribute themselves in high proportion toward the aqueous phase of a mixture of an electrolyte of the type electrolyzed in accordance with the present invention and the undissolved organic phase which, as aforesaid, may be present in the electrolyte during the electrolysis. Whether or not such an organic phase is present in substantial proportion in the aqueous solution during the electrolysis product hydrodimer is generally most conveniently removed from the electrolyzed electrolyte by adding to the electrolyte (either before or after the electrolysis) an amount of the olefinic starting material in excess of its solubility therein, mixing the solution and the excess olefinic compound until they are substantially equilibrated, and then separating (e.g. decanting) from the resulting mixture a first portion thereof that is richer than said mixture in the olefinic compound and therefore richer than said mixture in the hydrodimer product which is normally more soluble in the olefinic compound than in the electrolyzed aqueous electrolyte. Normally, the hydrodimer product is separated from said first portion of the mixture (e.g. by distillation) while a second portion of the mixture comprising an aqueous solution of the type subjected to electrolysis in accordance with the present invention is recycled and the aqueous solution comprised by said second portion is subjected to more of such electrolysis. In process embodiments in which the hydrodimer product is separated from the electrolyzed electrolyte in the manner just described and in view of the importance of having sufficient quaternary ammonium or phosphonium cations in the aqueous solution to maintain a high hydrodimer selectively on further electrolysis of the solution, the use of a quaternary cation that distributes itself in relatively high proportion in the aqueous portion of a substantially equilibrated mixture of the type just described is highly attractive from the standpoint of lessening the costs of recovering such cations from the separated (e.g. decanted) organic portion of the mixture and/or loss of such cations due to incomplete recovery from said organic portion of the mixture. Despite their generally higher carbon content, various bis-quaternary cations of the class defined hereinbefore have been found to distribute themselves toward the aqueous portion in ratios significantly higher (e.g. up to at least 3–4 times higher) than those of the corresponding mono-quaternary cations.

The conductive salt can be a quaternary ammonium or phosphonium salt such as, for example, a tetra-alkylammonium or -phosphonium phosphate, sulfate, alkyl-sulfate, (e.g. ethylsulfate) or arylsulfonate (e.g. toluene sulfonate). Although organic salts of that general type can be employed as the conductive salt in a divided or single-compartment (undivided) cell, it is generally preferred to use an alkali metal conductive salt, i.e., a salt of sodium, potassium, lithium, cesium or rubidium, especially in undivided electrolytic hydrodimerization (EHD) cells, and many attractive embodiments of the invention are carried out with enough alkali metal salt dissolved in the aqueous solution to provide alkali metal cations constituting more than half of the total weight of all cations in the solution. When such alkali metal salts are used, those of lithium and especially sodium and potassium are generally preferred for economic reasons.

Also preferred for such use are the salts of inorganic and/or polyvalent acids, e.g. a tetraalkyl-ammonium or -phosphonium or alkali metal orthophosphate, borate, perchlorate, carbonate or sulfate and particularly an incompletely-substituted salt of that type, e.g., a salt in which the anion has at least one valence satisfied by hydrogen and at least one other valence satisfied by an alkali metal. Examples of such salts include disodium phosphate ($Na_2HPO_4$), potassium acid phosphate ($KH_2PO_4$), sodium bicarbonate ($NaHCO_3$) and dipotassium borate ($K_2HBO_2$). Also useful are the alkali metal salts of condensed acids such as pyrophosphoric, metaphosphoric metaboric, pyroboric and the like (.e.g. sodium pyrophosphate, potassium metaborate, borax, etc.) and/or products of hydrolysis of such condensed acid salts. Depending on the acidity of the solution to be electrolyzed, the stoichiometric proportions of such anions and alkali metal cations in the solution may correspond to a mixture of two or more of such salts, e.g. a mixture of sodium acid phosphate and disodium phosphate, and accordingly, such mixtures of salts (as well as mixtures of salts of different cations, e.g. different alkali metals, and/or different acids, e.g. phosphoric and boric) are intended to be within the scope of the expressions "conductive salt" and "alkali metal phosphate, borate, perchlorate, carbonate or sulfate" as used herein. Any of the alkali metal salts may be dissolved in the aqueous solution as such or otherwise, e.g. as the alkali metal hydroxide and the acid necessary to neutralize the hydroxide to the extent of the desired acidity of the aqueous solution.

The concentration of conductive salt in the solution should be at least sufficient to substantially increase the electrical conductivity of the solution above its conductivity without such a salt being present. In most cases, a concentration of at least about 0.1% is favored. More advantageous conductivity levels are achieved when the electrolyte has dissolved therein at least about 1% of the conductive salt or, even more preferably, at least about 2% of such a salt. In many cases, optimum process conditions include the electrolyte having dissolved therein more than 5% (typically at least 5.5%) of the conductive salt. The maximum amount of salt in the solution is typically limited only by its solubility therein, which varies with the particular salt employed. With salts such as sodium or potassium phosphates and/or borates, it is generally most desirable that the electrolyte contain between about 8% and about 15% of such a salt or mixture thereof.

Generation of molecular hydrogen at the cathode of a process of the type discussed herein can be substantially inhibited by including in the aqueous electrolysis medium at least one nitrilocarboxylic acid compound such as, for example, a nitriloacetic or nitrilopropionic acid compound having the formula $Y_2N\text{-}(Z\text{—}ZN)_nR\text{-}''\text{—}COOM$ wherein Y is a monovalent radical such as hydrogen, —R″—COOM, $\text{-}(CH_2)_{m+1}OH$ or $C_1$–$C_{20}$ alkyl (preferably $C_1$–$C_{10}$ alkyl such as ethyl, n-propyl, tere-butyl, n-hexyl, n-decyl, etc.); —R″— is $\text{-}(CH_2)_m$ or $\text{-}(CHR'''\text{)-}$; R‴is hydroxyl, —COOM, $\text{-}(CH_2)_m\text{-}COOM$ or $C_1$–$C_8$ alkyl, hydroxalkyl (e.g. hydroxyethyl) or hydroxyphenyl (e.g. orthohydroxy-phenyl); Z is a divalent $C_2$–$C_6$ hydrocarbon (e.g. alkylene) radical such as, for example, n-hexylene, n-butylene, iso-butylene or, generally more desirably, ethylene or n-propylene; M is a monovalent radical such as hydrogen, an alkali metal (e.g. lithium or, usually more desirably, sodium or potassium) or ammonium; m is 1 or 2, n represents the number of repeating $\text{-}(Z\text{—}YN\text{)-}$groups, if any, and may be 0, 1, 2, 3 or 4; and at least one Y in the formula is —R″—COOM or $\text{-}(CH_2)_{m+1}$ OH, i.e., the compound contains at least one —R″—COOM or $\text{-}(CH_2)_{m+1}OH$ group in addition to the —R″—COOM group on the right hand end of the formula as shown hereinbefore. At least one such additional —R″—COOM or $\text{-}(CH_2)_{m+1}OH$ group is usually desirably attached to the nitrogen atom at the left-hand end of the formula but when n is 1, such an additional group may be attached (alternatively or otherwise) to the nitrogen atom in the $\text{-}(Z\text{—}YN\text{)-}$unit, and when n is 2, 3 or 4, any one or more of the nitrogen atoms in the repeating $\text{-}(Z\text{—}YN\text{)-}$units may have such an additional —R″—COOM or $\text{-}(CH_2)_{m+1}OH$ group attached thereto.

Preferably, but not necessarily, the sequesterant is an aminopolycarboxylic acid compound, i.e., one in which there are at least two —R″—COOM groups. It is also generally desirable for Y to be $C_2$–$C_4$ alkylene and for n to be 0, 1, 2 or 3 (even more desirable 0, 1 or 2 and most preferably 1 or 2). Representative of such compounds are nitrilotriacetic acid, diethylenetriamine-pentaacetic acid, N,N-di(2-hydroxyethyl)glycine, ethylenediaminetetrapropionic acid, N-N′-ethylenebis [2-(o-hydroxyphenyl)]glycine and, typically most favored, ethylenediaminetetraacetic acid and N-hydroxyethylethylene-diaminetriacetic acid (hereinafter sometimes presented as EDTA and HEDTA, respectively). In the low concentrations generally employed, they may be added to the electrolysis medium as acids or, usually more conveniently and particularly at the alkaline pH's favored for most embodiments of the invention, as partially or fully neutralized salts thereof (e.g. the water-soluble ammonium or alkali metal salts of such acids). In accordance with procedures known in the art, alkali metal salts of such nitrilocarboxylic acid compounds can be prepared by reacting an appropriate amine (e.g. ethylenediamine) with an alkali metal salt of a chloracetic acid in the presence of an alkali metal hydroxide, or with hydrogen cyanide and formaldehyde and then an alkali metal hydroxide, or with ethylene glycol to provide hydroxyethyl substituents of nitrogen atom(s) of the amine and then reacting the hydroxyethyl-substituted amine with an alkali metal hydroxide in the presence of cadmium oxide to convert the hydroxyethyl substituents to alkali metal acetate substituents in the proportion desired, or with acrylonitrile in the presence of a base (e.g. sodium hydroxide) and then hydrolyzing the cyanoethylated amine in the presence of an alkali metal hydroxide. Conveniently utilized salts of EDTA, HEDTA and other such nitrilocarboxylic acid compounds are also available commercially.

The minimum preferred concentration of the nitrilocarboxylic acid compound in the aqueous electrolysis medium is only that sufficient to inhibit formation of molecular hydrogen at the cathodic surface of the process. In general, at least about 0.025 millimol of the nitrilocarboxylic acid compound per liter of the solution is desirable and at least about 0.1 millimol per liter is preferred. In most cases having a greater attraction for commercial use, at least about 0.5 millimol per liter is more desirable and at least about 2.5 millimols per liter usually provides even better results. Generally, not more than about 50 millimols per liter are required, although higher concentrations may be employed if desired. Even more typically, economic results are better when the concentration of the nitrilocarboxylic acid compounds in the solution is not greater than 25 millimols per liter. With reference to such concentrations, it should be understood that the nitrilocarboxylic acid compounds used herein may degrade under the conditions of the process, e.g. to compounds that have lower molecular weight and/or fewer —R″—COOM or $-(CH_2)_{m+1}OH$ groups but which nevertheless provide the advantages of this invention in substantial measure, and accordingly such degradation products should be considered as equivalent to the undegraded nitrilocarboxylic acid compounds to the extent that they provide the advantages thereof, when measuring or otherwise indentifying a nitrilocarboxylic acid compound concentration with references to the process of this invention. Mixtures of two or more of the aforedescribed nitrilocarboxylic acid compounds may also be used in the process of this invention and accordingly, such mixtures are meant to be within the scope of the expression "a nitrilocarboxylic acid compound" as used in this disclosure and the appended claims.

Generation of hydrogen at the cathode is even more significantly inhibited by including in the electrolysis medium a boric acid, a condensed phosphoric acid or an alkali metal salt thereof. The boric acid or borate may be added to the solution as orthoboric acid, metaboric acid or pyroboric acid and then neutralized to the desired solution pH, e.g. with an alkali metal (preferably the cation of the conductive salt) hydroxide or as a completely or incompletely substituted alkali metal salt of such an acid (e.g. disodium or monosodium orthoborate, potassium metaborate, sodium tetraborate or the hydrated form thereof commonly called borax). The condensed phosphoric acid or phosphate may be added as a polyphosphoric (e.g. pyrophosphoric or triphosphoric) acid and then neutralized to the desired solution pH or as a completely or incompletely substituted alkali metal salt thereof (e.g. tetrasodium pyrophosphate or potassium hexametaphosphate or triphosphate).

In general, the condensed phosphoric acids and their alkali metal salts tend to hydrolyze in the electrolysis medium at rates dependent on their concentration, the solution pH, etc. It is believed, however, that the products of such hydrolysis continue to inhibit the generation of hydrogen at the cathode so long as they remain condensed to at least some degree, i.e., so long as they have not been hydrolyzed to the orthophosphate form, and hence the preferred concentrations of such condensed phosphoric acid compounds are herein expressed in terms of weight percent of a condensed phosphoric acid (which may be that originally added to the solution of hydrolysis products thereof having a lower but conventionally recognizable degree of molecular condensation) or the molar equivalent of an alkali metal salt thereof. When such a condensed phosphoric acid is used in the process of this invention and particularly in an undivided cell having a metallic anode (e.g. an anode comprising a ferrous metal such as carbon steel, alloy steel, iron or magnetite), it is generally advantageous for the solution to contain at least about 0.01% preferably between about 0.02% and about 3%, and often most desirably between about 0.02 and about 2% of the condensed phosphoric acid or the molar equivalent (molecularly equivalent amount) of an alkali metal salt thereof.

The aforementioned boric acids and alkali metal salts thereof, on the other hand, tend to relatively rapidly form in the electrolysis medium a variety of boron-containing ions having relative proportions normally dependent on their concentrations, the solution pH, etc., and generally including both uncondensed (i.e., orthoborate) and condensed (e.g. metaborate, tetraborate, polymeric, ring-containing, etc.) ions, regardless of whether the acids and/or salts originally added to the electrolysis medium were in condensed or uncondensed form at that time. In other words, condensed borates (e.g. tetraborates) normally convert in the electrolysis medium in part to orthoborate ions and in part to other condensed borate ions, while orthoborates added as such generally form various condensed borate ions, depending largely on the solution pH, etc. In any event, it appears that the boron-containing ions are effective for purposes of this invention whether they are present in condensed or uncondensed forms or a mixture thereof and accordingly, preferred concentrations of the boric acids or salts are herein expressed (on the basis of one liter of solution) in terms of gram atoms of boron which may be present in the ionic form of condensed or uncondensed borates or other boron-containing moieties provided by interaction between the electrolysis medium and the boric acids and/or salts added thereto. When such boric acids or salts are used in the process of this invention, and particularly in an undivided cell having a metallic anode (e.g. an anode comprising a ferrous metal such as carbon steel, alloy steel, iron or magnetite), it is generally desirable for the boron concentration in the electrolysis medium to be at least about 0.01 and preferably 0.02 gram atom of boron per liter of solution. It is generally not necessary that the boron concentration in the solution be greater than about 0.09 gram atom per liter and in many cases it need not be greater than about 0.05 gram atom per liter, although higher concentrations are not necessarily detrimental and may be advantageous, e.g. if it is intended that a boric acid salt provide a substantial portion of the electrical conductivity of the electrolysis medium.

In most cases, the pH of the bulk of the electrolysis medium is at least about two, preferably at least about five, more preferably at least about six and most conveniently at least about seven, especially when the process is carried out in an undivided cell having a metallic anode. On the other hand, the overall electrolyte pH is generally not higher than about 12, typically not higher than about 11 and, with the use of sodium or potassium phosphates and/or borates, generally not substantially higher than about 10.

The temperature of the electrolyte may be at any level compatible with existence of such of the solution itself, i.e., above its freezing point but below its boiling point under the pressure employed. Good results can be achieved between about 5° and about 75° C. or at even higher temperatures if pressures substantially above one atmosphere are employed. The optimum temperature range will vary with the specific olefinic compound and hydrodimer, among other factors, but in hydrodimerization of acrylonitrile to adiponitrile, electrolysis temperatures of at least about 25° are usually preferred and those between about 40° and about 65° C. are especially desirable.

As is well-known, electrolytic hydrodimerization of an olefinic compound having a formula as set forth above must be carried out in contact with a cathodic surface having a cathode potential sufficient for hydrodimerization of that compound. In general, there is no minimum current density with which the present process can be carried out at such a cathodic surface but in most cases, a current density of at least about 0.01 amp per square centimeter (amp/cm$^2$) of the cathodic surface is used and a current density of at least about 0.05 amp/cm$^2$ is usually preferred. Although higher current densities may be practical in some instances, those generally employed in the present process are not higher than about 1.5 amp/cm$^2$ and even more typically not higher than about 0.75 amp/cm$^2$ of the aforedescribed cathodic surface. Depending on other process variables, current densities not higher than about 0.5 amp/cm$^2$ may be preferred in some embodiments of the process.

Although not necessary, a liquid-impermeable cathode is usually preferred. With the use of such a cathode, the electrolyte is generally passed between the anode and cathode at a linear velocity with reference to the adjacent cathodic surface of at least about 0.3 meter per second, preferably at least about 0.6 meter per second and even more preferably between about 0.9 and about 2.4 meters per second although a solution velocity up to 6 meters per second or higher can be employed if desired. The gap between the anode and cathode can be very narrow, e.g. about 1 millimeter or less, or as wide as 12.5 millimeters or even wider, but is usually most conveniently of a width between about 1.5 and about 6.2 millimeters. In the preferred process of this invention, the cathodic potential can be provided and which is not dissolved or corroded at an intolerable rate. In general, the process can be carried out with a cathode consisting essentially of cadmium, mercury, thallium, lead, zinc, manganese, tin (possibly not suitable with some nitrile reactants) or graphite, by which is meant that the cathodic surface contains a high percentage (generally at least about 95% and peferably at least about 98%) of one or a combination (e.g. an alloy) of two or more of such materials, but it may contain a small amount of one or more constituents that do not alter the nature of the cathodic surface so as to prevent substantial realization of the advantages of the present invention, particularly as described herein. Such other constituents, if present in substantial concentration, are preferably other marterials having relatively high hydrogen over voltages. Of particular preference are cathodes consisting essentially of cadmium, lead, zinc, manganese, graphite or an alloy of one of such metals, and especially cathodes consisting essentially of cadmium. Best results are usually obtained with a cathodic surface having a cadmium content of at least about 99.5% even more typically at least about 99.8% and most desirably at least about 99.9% as in ASTM Designation B440-66T (issued 1966).

Cathodes employed in this invention can be prepared by various techniques such as, for example, electro-plating of the desired cathode material on a suitably-shaped substrate of some other material, e.g. a metal having greater structural rigidity, or by chemically, thermally and/or mechanically bonding a layer of the cathode material to a similar substrate. Alternatively, a plate, sheet, rod or any suitable configuration consisting essentially of the desired cathode material may be used without such a substrate, if convenient.

The preferred process of this invention is carried out in cells in which the electrolyte is in direct physical contact with an anode and cathode of the cell. In fact, and particularly without the presence of a boric or condensed phosphoric acid or salt thereof in the preferred concentrations described hereinbefore, it has been found that the aforementioned nitrilocarboxylic acid compounds, and especially in the concentration cited hereinbefore, generally substantially inhibit the corrosion of metallic anodes when used in such undivided cells.

An especially preferred embodiment of the invention is carried out in an undivided cell having an anode comprising a ferrous metal and with the use of an alkali metal phosphate, borate or carbonate conductive salt and an electrolysis medium having a pH not substantially below seven. Of potential interest from the economic standpoint are those embodiments employing an anode consisting essentially of carbon steel, exemplary compositions of which are listed in the 1000, 1100 and 1200 series of American Iron and Steel Institute and Society of Automotive Engineers standard steel composition numbers, many of which may be found on page 62 of Volume 1, Metals Handbook, 8th Edition (1961) published by the American Society for Metals, Metals Park, Ohio.

In general, the carbon steels that are advantageously used as anode materials in the process of this invention contain between about 0.02% carbon (more typically at least about 0.05% carbon) and about 2% carbon. Normally, carbon steels such as those of the AISI and SAE 1000 series of standard steel composition numbers are preferred and those containing between about 0.1% and about 1.5% carbon are typically most desirable. Regardless of the material from which it is made, each anode in the cell may be in the form of a plate, sheet, strip, rod or any other configuration suitable for the use intended. In a preferred embodiment, however, the anode is in the form of a sheet (e.g. of cold-rolled carbon steel) essentially parallel to and closely spaced from a cathodic surface of approximately the same dimensions.

As stated above, the invention herein lies in the injection of a noncompeting gas into the cell. Such injection may be direct into the cell or indirect to the cell through the cell feed or other stream. If injected into the cell feed stream, it is preferably injected above the pressure of the cell feed stream at a ratio of 0.005–0.20 cc/cc of cell feed. The optimum ratio is a function of the cell operating pressure, and the ratio of the gas to cell feed should be adjusted to give the optimum balance of reduced corrosion and enhanced current efficiency. If an excess of gas is introduced into the cell feed, it may well enhance cathode corrosion. With the diminution of oxygen in the electrolyte, significant decreases in cathodic corrosion will be obtained. At higher cell pressures of equal to or greater than 2.5 atmospheres, and/or at high organic/aqueous phase ratios, the reduction in corrosion and the increase in current efficiency are dramatic.

While the following should not be construed to be delimiting, it has been theorized that in a process for the production of adiponitrile according to the above described process, the following may occur at the anode:

$$2OH^- \rightarrow O_2 + 2H^+ + 4\epsilon \quad (1)$$

and the following may occur at the cathode:

$$2AN + 2\epsilon + 2H^+ \rightarrow ADN \text{ (desired)} \quad (2)$$

$$O_2 + 2 \text{ to } 4\epsilon \rightarrow HOOH \text{ to } 2OH^- \text{ (undesired)} \quad (3)$$

$$2H_2O + O_2 + 4\epsilon \rightarrow 4OH^- \text{ (undesired)}$$

In a typical electrohydrodimerization in which the electrolyte contains a nitrilocarboxcyclic acid such as ethylenediaminetetraacetic acid, it is entirely possible that droplets or gas bubbles may accumulate at the cathode and locally reduce the flow of current to a point below that required for cathodic polarization, and dissolved oxygen can oxidize a cathodic surface such as cadmium from the 0 to +2 valence with subsequent dissolution by the ethylenediaminetetraacetate and a resultant high corrosion.

As stated above the gases which may be employed in accordance with this invention as noncompeting gases include any gas which does not consume substantial electricity while being reduced or oxidized. Non-competing gases ordinarily include any gas or mixture of gases having an activity substantially less than that of pure oxygen. So far as the specific process described above, such gases include, for example, nitrogen, helium, hydrogen, argon, air, and mixtures of such gases which may include but preferably do not include oxygen in excess of the concentration of $O_2$ in air.

The following specific examples of the process of this invention are included for purposes of illustration only and do not imply any limitations on the scope of the invention. Also in these examples, acrylonitrile and adiponitrile are generally represented by AN and ADN, respectively.

EXAMPLES 1-27

The electrolytic cell consisted of a 12 foot vertical channel, one inch wide, with a 0.073 inch gap between two flat plate electrodes. The cathode surface was cadmium; the anode surface was steel. The cell was operated at a current density of 0.18 amps/cm$^2$. The cell operating pressure was set by controlling the cell exit pressure at 55 psig.

The cell feed, which was circulated through the cell at a rate of 3300 cc/min, consisted of about 10% organic phase and 90% aqueous phase. Feed streams to the continuous process consisted of AN at a rate of ca 350 gm/hr and an aqueous electrolyte solution at a rate of ca 315 gm/hr. The aqueous electrolyte consisted of 93.76 weight % water, 3.98 weight % sodium hydrogen phosphate, 1.65 weight % boric acid, 0.66 weight % quaternary ammonium salt, 0.44 weight % ethylenediaminetetraacetic acid, and 0.10 weight % triethanolamine.

An organic product stream and an aqueous purge stream were removed at rates of ca 330 gm/hr and ca 200 gm/hr respectively, the balance of the material leaving as off-gas and vapor. The organic product stream consisted of 88% ADN on an AN and $H_2O$ free basis.

After the cell effluent was let down to near atmospheric pressure, it passed through an off-gas separator and a decanter. From the decanter, the aqueous phase was mixed with the AN and aqueous electrolyte makeup streams. Sufficient turbulence was created in the decanter by a separate circulating pump to cause a 10% dispersion of organic phase in the aqueous phase. The purpose of the dispersion was to simulate adverse operating conditions. The cadmium corrosion rate at these conditions was calculated (on the basis of cadmium concentration in the aqueous phase and turnover time) to be 8.8 mils/yr (where 1 mil=0.001 inch).

EXAMPLE 1

When bottled nitrogren was metered through a calibrated rotameter into the cell feed downstream of the circulating pump but upstream of a flow control valve, at a rate of 275 std. cc/min (where std. refers to 0° C. and 1 atm. pressure), the cadmium corrosion rate dropped to 2.8 mils/yr.

COMPARATIVE EXAMPLE 2

When oxygen was metered into the cell feed at a rate of 275 std. cc/min., the cadmium corrosion rate increased to 11.4 mils/yr.

EXAMPLE 3

When air was metered into the cell feed at a rate of 300 std. cc/min., the cadmium corrosion rate dropped to 3.4 mils/yr.

COMPARATIVE EXAMPLE 4

When gas injection was discontinued, the cadmium corrosion rate rose to 7.2 mils/yr. Each set of conditions was maintained for approximately 96 hours.

Additional runs were made at various operating conditions. The results (which inlude the foregoing examples) appear below. Although ADN production rates are included, the scatter in the data virtually obscures the current efficiency effect.

TABLE I

| Example No. | Cell Exit Pressure (psig) | Injected Gas Type/Rate (Std.cc/min) | % Organic Phase (%) | Cadmium Corrosion Rate (mils/yr) | ADN Production Rate (gm/hr) |
|---|---|---|---|---|---|
| 5 | 36 | $N_2$ 275 | 4 | 3.0 | 253 |
| 6* | 23 | none | 4 | 7.0 | 251 |
| 7 | 56 | $N_2$ 635 | 4 | 3.0 | 256 |
| 8 | 55 | $N_2$ 383 | 4 | 3.0 | 240 |
| 9 | 15 | $N_2$ 164 | 4 | 2.5 | 259 |
| 10 | 35 | $N_2$ 275 | 4 | 2.0 | 259 |
| 11* | 55 | none | 4 | 7.6 | 220 |
| 12* | 35 | none | 4 | 8.2 | 241 |
| 13 | 16 | $N_2$ 91 | 4 | 1.8 | 254 |
| 14* | 16 | none | 4 | 2.3 | 254 |
| 15* | 55 | none | 4 | 7.7 | 225 |
| 16* | 55 | none | 10 | 8.8 | 224 |
| 17 | 55 | $N_2$ 275 | 10 | 2,8 | 224 |
| 18* | 55 | $O_2$ 275 | 10 | 11.4 | 199 |
| 19 | 55 | Air 300 | 10 | 3.4 | 227 |
| 20* | 55 | none | 10 | 7.2 | 218 |
| 21 | 35 | $N_2$ 275 | 4 | 1.6 | 240 |
| 22 | 35 | Air 91 | 4 | 1.8 | 235 |
| 23 | 35 | $N_2$ 91 | 4 | 1.6 | 233 |
| 24* | 15 | $O_2$ 137 | 4 | 8.3 | — |
| 25* | 15 | $O_2$ 550 | 4 | 98.3 | — |
| 26* | 15 | $O_2$ 366 | 4 | 20.0 | — |

TABLE I-continued

| Example No. | Cell Exit Pressure (psig) | Injected Gas Type/Rate (Std.cc/min) | % Organic Phase (%) | Cadmium Corrosion Rate (mils/yr) | ADN Production Rate (gm/hr) |
|---|---|---|---|---|---|
| 27 | 15 | none | 4 | 4.0 | 265 |

*comparative examples

EXAMPLES 28-57

The same electrolytic cell and process described in Example 1 were operated at the various operating conditions shown at Table II. After passing through a chilled water condenser, the off-gas was routed through a series of cold traps chilled by dry ice and methanol to a wet test meter. The effect of gas injection on current efficiency becomes apparent when one measures the rate of oxygen evolution—with and without gas injection.

The following data were collected over a period of several months. Off-gas rates were measured for approximately one hour in order to reduce error to an acceptable level:

TABLE II

| Example No. | Cell Exit Pressure (psig) | Injected Gas Type | Injected Gas Rate (Std/cc/min) | % Organic Phase (%) | Evolved Oxygen (Std.cc/min) | Current Efficiency Increase (%) |
|---|---|---|---|---|---|---|
| 28* | 22 | none | | 3 | 535 | — |
| 29 | 24 | $N_2$ | 287 | 3 | 538 | .005 |
| 30* | 53 | none | | 3 | 496 | — |
| 31 | 55 | $N_2$ | 606 | 3 | 521 | .042 |
| 32* | 53 | none | | 7 | 486 | — |
| 33 | 55 | $N_2$ | 592 | 7 | 539 | .092 |
| 34* | 15 | none | | 4 | 547 | — |
| 35 | 16 | $N_2$ | 150 | 4 | 558 | .018 |
| 36* | 33 | none | | 3 | 519 | — |
| 37 | 35 | $N_2$ | 255 | 3 | 547 | .047 |
| 38* | 31 | none | | 4 | 520 | — |
| 39 | 33 | $N_2$ | 250 | 4 | 561 | .069 |
| 40* | 56 | none | | 4 | 501 | — |
| 41 | 58 | $N_2$ | 253 | 4 | 531 | .050 |
| 42 | 58 | $N_2$ | 160 | 4 | 522 | .035 |
| 43* | 56 | none | | 4 | 488 | — |
| 44* | 16 | none | | 4 | 538 | — |
| 45* | 16 | none | | 14 | 526 | — |
| 46* | 55 | none | | 14 | 484 | — |
| 47* | 55 | none | | 0 | 494 | — |
| 48* | 16 | none | | 0 | 543 | — |
| 49* | 16 | none | | 4 | 541 | — |
| 50 | 16 | $N_2$ | 90 | 2 | 553 | .013 |
| 51* | 16 | none | | 2 | 545 | — |
| 52 | 55 | $O_2$ | 265 | 12 | 441 | (.086) |
| 53* | 55 | none | | 12 | 492 | — |
| 54 | 56 | Air | 288 | 10 | 513 | .025 |
| 55* | 56 | none | | 10 | 498 | — |
| 56 | 36 | Air | 267 | 4 | 537 | .010 |
| 57* | 36 | none | | 4 | 531 | — |

*comparative examples

Oxygen evolution was calculated by subtracting hydrogen (as determined by an on-stream analyzer) and injected gas (as measured in a separate test) from the total dry off-gas flow rate. The difference between oxygen evolution with and without gas injection should be the amount of oxygen that is prevented (by gas injection) from being reduced at the cathode. The ratio of this difference to the theoretical oxygen evolution rate for the electrolytic cell (assuming other anodic reactions are negligible) should be an approximate measure of current efficiency improvement. In this case, the theoretical oxygen evolution rate was 596 std. cc/min.

We claim:

1. In a continuous process for hydrodinergizing an olefinic compound having the formula $R_2C{=}CR{-}X$ wherein —X is —CN, —$CONR_2$ or —COOR; R is hydrogren or R′ and R′ is $C_1$ —$C_4$ alkyl, to form a dimerized product, which comprises electrolyzing in an undivided reaction cell an aqueous electrolyte having dissolved therein at least 0.1% by weight of the olefinic compound, at least $10^{-5}$ gram mol per liter of quaternary ammonium cations of a directive salt and at least 0.1% by weight of conductive salt, the aqueous electrolyte being in contact with a cathodic surface having a cathode potential sufficient for hydrodimerization of the olefinic compound with incidental formation of oxygen at the anodic surface, purging the aqueous electrolyte and recovering therefrom dimerized product, and reconstituting the aqueous electrolyte with the olefinic compound, fresh and recovered conductive salt and fresh and recovered quaternary ammonium salt, the improvement comprising charging to the electrolyte during electrolyzing an effective amount of a non-competing gas as herein defined whereby the concentration of oxygen in the aqueous electrolyte and at the cathodic surface is significantly lowered with a commensurate diminishing in corrosion of the cathodic surface.

2. The process improvement of claim 1 wherein the non-competing gas is a member of the group consisting of nitrogen, helium, hydrogen, argon, air, and mixtures of the above.

3. The process improvement of claim 1 wherein the non-competing gas is nitrogen.

4. The process improvement of claim 1 wherein the olefinic compound is acrylonitrile and the dimerized product of adiponitrile.

5. In a continuous electrohydrodimerization process which comprises electrolyzing in an undivided reaction cell containing an electrolyte containing a reduceable compound, the electrolyte being in contact with a cathodic surface having a cathode potential sufficient for the electrochemical reduction of the dissolved reduceable compound, with incidental formation of oxygen at the anodic surface, purging the electrolyte from the cell and recovering therefrom the reduced product, and thereafter reconstituting the electrolyte with the compound to be reduced, the improvement comprising charging to the electrolyte during electrolyzing an effective amount of a non-competing gas as herein defined whereby the concentration of oxygen in the electrolyte and at the cathodic surface is significantly lowered.

* * * * *